US005649834A

United States Patent [19]

Allison et al.

[11] Patent Number: 5,649,834

[45] Date of Patent: Jul. 22, 1997

[54] SELF-ALIGNING ELECTRICAL CONNECTOR

[75] Inventors: John Hugh Allison, Plymouth; Gerald Arthur Heath, Canton, both of Mich.; Richard Granitz, Harrisburg, Pa.

[73] Assignee: Ford Motor Company, Dearborn, Mich.

[21] Appl. No.: 554,058

[22] Filed: Nov. 6, 1995

[51] Int. Cl.[6] ..... H01R 13/74

[52] U.S. Cl. ..... 439/247

[58] Field of Search ..... 439/247, 248, 439/246, 552–554, 556, 374

[56] References Cited

U.S. PATENT DOCUMENTS

| | | | |
|---|---|---|---|
| 2,369,860 | 2/1945 | Schroeder | 173/328 |
| 3,493,916 | 2/1970 | Hansen | 339/17 |
| 4,066,312 | 1/1978 | Faure | 339/48 |
| 4,074,082 | 2/1978 | Sato et al. | 179/100 |
| 4,146,286 | 3/1979 | Jones | 339/48 |
| 4,162,816 | 7/1979 | Malsot | 339/64 |
| 4,410,230 | 10/1983 | SanMiguel | 439/79 |
| 4,431,242 | 2/1984 | Gisewsky | 339/48 |
| 4,874,316 | 10/1989 | Kamon et al. | 439/39 |
| 4,905,938 | 3/1990 | Braccio et al. | 244/161 |
| 4,909,748 | 3/1990 | Kozono et al. | 439/248 |
| 4,921,435 | 5/1990 | Kane et al. | 439/248 |
| 4,998,887 | 3/1991 | Kaufman et al. | 439/248 |
| 5,004,430 | 4/1991 | DelGuidice | 439/350 |
| 5,138,679 | 8/1992 | Edwards et al. | 439/248 |
| 5,451,169 | 9/1995 | Corbett, III et al. | 439/289 |

FOREIGN PATENT DOCUMENTS

| | | | |
|---|---|---|---|
| 589623 | 10/1929 | Germany | 439/289 |
| 712880 | 1/1980 | U.S.S.R. | 439/248 |

OTHER PUBLICATIONS

AMP Catalog 82045, Revised Sep. 1994, Drawer Connectors, pp. 32–33.

*Primary Examiner*—Gary F. Paumen

*Attorney, Agent, or Firm*—Donald A. Wilkinson; Roger L. May

[57] ABSTRACT

A novel electrical connector assembly is disclosed. An embodiment of the electrical connector assembly includes a guide sleeve having a tapered interior and electrical contacts disposed therein. The guide sleeve receives a tapered housing having corresponding electrical contacts for mating with the electrical contacts of the guide sleeve. An alternate embodiment of the electrical connector assembly has a connection mechanism using a flat contact surface and a round tipped contact surface to maintain electrical contact while allowing for movement of the contacts in any direction along the surface of the flat contact surface.

12 Claims, 2 Drawing Sheets

SELF-ALIGNING ELECTRICAL CONNECTOR

BACKGROUND OF THE INVENTION

1. Field of the Invention

Embodiments of the present invention relate generally to electrical connector assemblies for electrically connecting two stationary substrates. More particularly, embodiments of the present invention relate to electrical connector assemblies having a mechanism to align interconnecting elements which may be out of alignment prior to connection. More particularly, embodiments of the present invention relate to electrical connector assemblies which are capable of making a blind connection between electrically conductive components located on separate panel elements that are to be installed relative to one another, such as an electrical device and a cluster panel. In one aspect, the present invention relates to electrical connector assemblies having a tapered guide sleeve with electrical contacts disposed therein for receiving and electrically connecting electrical contacts disposed within a correspondingly tapered housing. The tapered characteristic of the guide sleeve and the tapered housing allow the electrical contacts associated with each component to become self-aligned prior to connection of contact elements. In a further aspect, the electrical connector assemblies have contact components which are electrically conductive while allowing for movement between the contact components in a forward and backward direction, and in any direction within a 360 degree radius of the contact points.

2. Description of Related Art

Arrangements for the blind mating of electrical connections between substrates are known. For example U.S. Pat. No. 4,921,435 discloses a blind mating connector for simultaneously providing electrical and mechanical connection of an electrical component to an instrument panel. Printed circuit board terminals and connectors, see U.S. Pat. No. 3,493,916, as well as, various configurations for electrical contacts are also known. See U.S. Pat. No. 4,410,230, U.S. Pat. No. 5,004,430, U.S. Pat. No. 4,146,286, U.S. Pat. No. 4,066,312, U.S. Pat. No. 4,431,242, U.S. Pat. No. 4,162,816, U.S. Pat. No. 2,369,860, U.S. Pat. No. 3,493,916 and German Patent No. 589,623.

However, these arrangements suffer disadvantages in that they fail to provide a reliable electrical connector assembly design which is capable of gradually self-aligning electrical connectors as they are brought together for connection. Additionally, these arrangements fail to provide a reliable tolerance for the misalignment of electrical contacts, as well as, for reliable movement between electrical connectors in any direction. Consequently, an electrical connector assembly for the blind mating of electrical components is needed which overcomes the disadvantages of the prior art.

SUMMARY OF THE INVENTION

Embodiments of the present invention relate generally to an electrical connector assembly which is capable of correcting the alignment of electrical contacts between electrically conductive components located on separate panel elements that are to be installed relative to one another. A tapered housing is movably disposed between a back contact panel and a front collar panel. The tapered housing has front electrical contacts disposed at the front face and exterior leads disposed at the back face of the tapered housing with the front electrical contacts being electrically connected to corresponding exterior leads. The front collar panel has an opening through which the tapered housing extends which is referred to herein as a tapered extension. A guide sleeve having a tapered interior is designed to receive the tapered extension. The guide sleeve has electrical contacts disposed at the rear section of the guide sleeve such that the front electrical contacts mate with the electrical contacts of the guide sleeve when the tapered extension is inserted into the guide sleeve. The movability of the tapered housing facilitates the connection between corresponding mating electrical contacts when they are brought together for connection on an axis which is slightly off of the center axis of both electrical contacts, since the movable tapered housing is capable of correcting itself within the guide sleeve as it nears the rear section of the guide sleeve.

Embodiments of the present invention are advantageous in that they provide an electrical connector assembly which facilitates the mating of electrically conductive components which are frequently required to be connected "blindly" or without direct action by an individual, such as with the interconnection of an automobile instrument panel with a printed circuit board. The substrates to be interconnected are generally stationary and are usually aligned prior to interconnection. Embodiments of the present invention are further advantageous in that they provide a reliable electrical connector assembly which is capable of self-aligning two sets of electrical contacts which are brought together for connection slightly out of alignment. Embodiments of the present invention are further advantageous in that they provide an electrical connector assembly which allows for movement between conductive contacting members, which may occur due to vibrations, while maintaining electrical contact between the conductive members themselves. This tolerance feature is especially important when movement between conductive members occurs during blind installation or as a result of later use. This tolerance feature of the electrical connector assembly allows it to function despite the movement of the electrical connectors. Electrical connectors which do not provide for such a tolerance often lead to premature failure and replacement due to movement which breaks the electrical connection between non-movable electrical contacts.

It is accordingly an object of the present invention to provide an electrical connector assembly for improving the efficiency and reliability of electrical connections between substrates which are made blindly, such as with the robotic mating of electrical components. It is an additional object of the present invention to provide an electrical connector assembly for improving the efficiency and reliability of electrical connections which are subject to movements between electrically conductive components. It is a further object of the present invention to improve the reliability and performance of electrical connectors in general.

Other objects, features or advantages of the present invention will become apparent from the following description taken in conjunction with the accompanying drawings.

BRIEF DESCRIPTION OF THE DRAWINGS

In the course of the detailed description of certain preferred embodiments to follow, reference will be made to the attached drawings, in which.

DETAILED DESCRIPTION OF PREFERRED EMBODIMENTS

Figure 1:
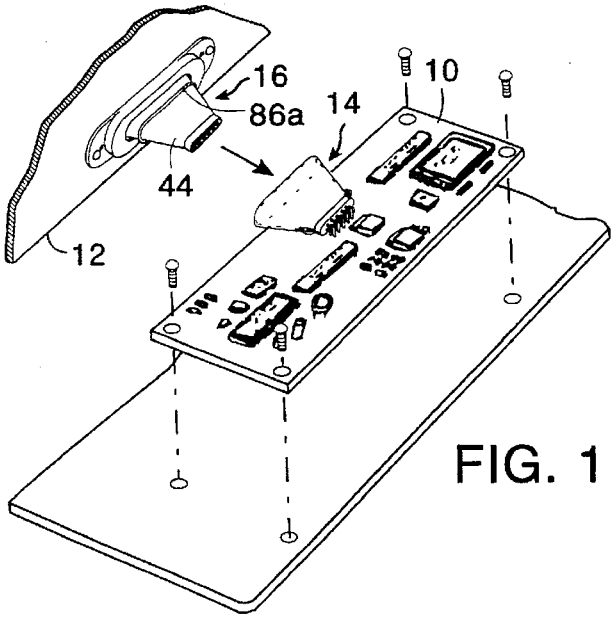
FIG. 1 is an exploded view of two substrates which are intended to be connected by an embodiment of the electrical connector assembly in accordance with the teachings of the present invention.

The principles of the present invention may be applied with particular advantage to provide an electrical connector assembly which is useful in the blind mating of two electrical connections. As can be seen in the exploded view in FIG. 1, a first substrate 10, which can be any electrical device, such as for example, a radio, an instrument cluster, a heater control unit, or a printed circuit board as depicted in FIG. 1, is desired to be interconnected with a second substrate 12, such as a cluster panel. The two substrates are generally stationary in that they are brought together along the same axis for interconnection by mechanical means, such as a robotic device, but are prevented from significant movement during interconnection other than movement along the axis of insertion. Misalignment along the axis of insertion of the electrical connectors is, therefore, a major cause of connector damage, such as connector bending or breakage, during the connection process.

An electrical connector assembly in accordance with the teachings of the present invention having a tolerance for the misalignment of connector components is shown generally as a first component 14 which is connected to first substrate 10 and a second component 16 which is connected to second substrate 12. The two substrates 10 and 12 are then intended to be electrically interconnected via first component 14 and second component 16, and may often be interconnected by robotic means. Generally, the two substrates 10 and 12 are aligned on a longitudinal axis between the first component 14 and the second component 16, with substantially little or no movement between the two components and their respective substrates, and are then forced together thereby joining corresponding electrical contacts associated with each component. Should the first and second components 14 and 16 be slightly out of alignment, the electrical connector assembly of the present invention provides for a tolerance between the components to allow the first and second components to adjust and realign themselves as they are brought closer and closer together until alignment is sufficient to allow the first and second components to interconnect without breakage or bending of connector elements.

Figure 2:
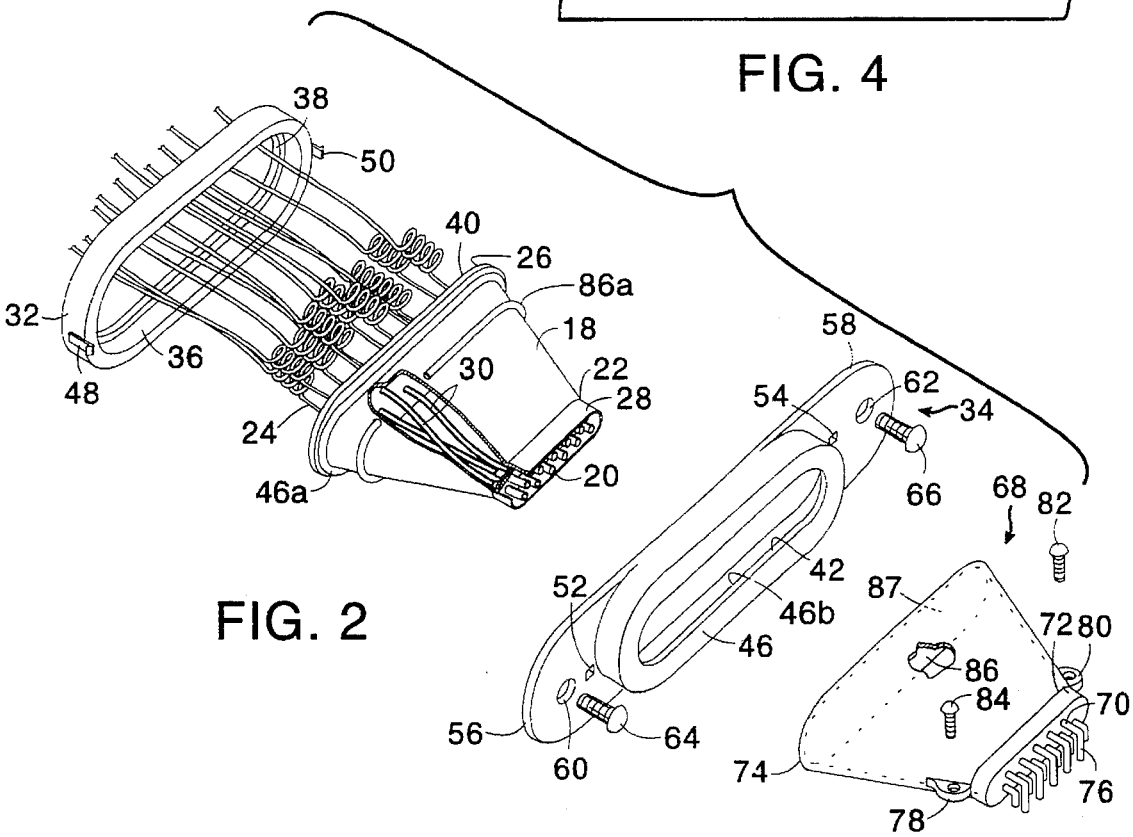
FIG. 2 is an exploded view of one embodiment of an electrical connector assembly of the present invention.

One embodiment of the electrical connector assembly of the present invention which allows for self-aligning in the manner discussed above is depicted in the lo exploded view of FIG. 2. As can be seen in FIG. 2, a tapered housing 18 has front electrical contacts 20 disposed at front face 22 and has exterior leads 24 disposed at back face 26. Tapered housing 18 is generally shown to be rounded and progressively narrower along at least one dimension, when viewed from back face 26 to front face 22. It is to be understood, however, that tapered housing 18 may be tapered along several dimensions including length, height and width to achieve a tapered housing which is useful in the practice of the present invention.

Front electrical contacts 20 are depicted as being a plurality of female-type electrical contacts insofar as they are intended to mate with and receive a male-type electrical contact, such as a tab or post. In a preferred embodiment, front electrical contacts 20 are embedded into and extend from front face 22 of tapered housing 18, as shown in FIG. 2, and are shielded by protector 28 which extends beyond front face 22 to the ends of front electrical contacts. Protector 28 protects front electrical contacts 20 from being broken or bent during connection. The front electrical contacts 20 are electrically connected to corresponding exterior leads 24 by wires 30 which are disposed within tapered housing 18. As shown in FIG. 2 the exterior leads 24 are disposed at the back face 26 of tapered housing 18 and are intended to be connected to a power source (not shown) whether directly or by a wire extension. As shown in FIG. 2, exterior leads 24 are depicted as wires which extend from front electrical contacts 20, through the interior of tapered housing 18 and exiting back face 26 of tapered housing 18. In a preferred embodiment, exterior leads 24 are fixedly disposed at back face 26 of tapered housing 18 and are of the pig tailed variety as shown in FIG. 2 which allows for a tolerance of any vibration or other movement of tapered housing 18.

Tapered housing 18 is movably disposed between back contact panel 32 and front collar panel 34. Back contact panel 32 is show in FIG. 2 as being generally oblong in shape and has opening 36 which is designed to receive exterior leads 24 and back face 26 of tapered housing 18. As depicted in FIG. 2, exterior leads 24 in the form of wires extend through opening 36. Back contact panel 32 also has first flange 38 extending radially inward into opening 36. Tapered housing 18 has second flange 40 extending radially outward from back face 26. Second flange 40 of tapered housing 18 is shown as being generally oblong in shape and is designed to be received into opening 36 of back contact panel 32 and to contact first flange 38 to prevent tapered housing 18 from passing completely through back contact panel 32. As such, first flange 38 is designed to have a configuration to prevent tapered housing 18 from passing through opening 36 of back contact panel 32.

Also depicted in FIG. 2 is front collar panel 34 having opening 42 through which tapered housing 18 extends. The section of tapered housing 18 which extends through opening 42 is referred to herein as a "tapered extension" 44 which is more clearly seen in FIG. 1. Front collar panel 34 has collar 46 for receiving tapered housing 18 and for contacting second flange 40 to prevent tapered housing 18 from completely passing through front collar panel 34. As such, second flange 40 is designed to have a configuration to prevent tapered housing 18 from passing through opening 42 of front collar panel 34. Also second flange 40 resides within collar 46 and is capable of floating within collar 46 in any direction within the plane of collar 46. Accordingly, tapered housing 18 is able to move, along with second flange 40, in any direction parallel to the plane of front collar panel 34. In a preferred embodiment, second flange 40 is uniformly smaller than the interior **46*b* of collar 46 which enables second flange 40 to freely move in any direction within collar 46. Also seen in FIG. 2 is spring mechanism 46*a* which is disposed between tapered housing 18 and front collar panel 34. Spring mechanism 46*a* contacts the interior surface 46*b* of collar 46 such that tapered housing 18 is capable of moving in a backward or forward direction relative to front collar panel 34. Spring mechanism 46*a* is preferably depicted as a circular rubber ring abutting second flange 40. Spring mechanism 46*a* is advantageous in that it is designed to allow tapered extension 18 to move in a backward or forward motion while within the confines of back contact panel 32 and front collar panel 34** to aid in the connection of electrical contact elements. Spring mechanism 46*a* is further advantageous in that it aids in the dampening of vibrations which may lead to electrical contact failure. It is to be understood that other suitable spring mechanisms are useful according to the teachings of the present invention. Front collar panel 34 is fixedly mounted to back contact panel 32 by means of snaps 48 and 50 which interlock with openings 52 and 54 located on front collar panel 34, with tapered housing 18 being movably disposed therebetween. Front collar panel 34 includes tab sections 56 and 58 having holes 60 and 62 for receiving screws 64 and 66 for removably mounting front collar panel 34 and, accordingly, second component 16 to second substrate 12.

Also depicted in FIG. 2 is guide sleeve generally shown at 68 as being tapered in a manner similar to tapered housing 18 and having rear electrical contacts 70 disposed at rear section 72 of the guide sleeve 68. Guide sleeve 68 is generally shown to be progressively narrower along at least one dimension, when viewed from forward face 74 to rear face 72. It is to be understood, however, that guide sleeve 68 may be tapered along several dimensions including length, height and width to achieve a guide sleeve which is useful in the practice of the present invention.

Rear electrical contacts 70 are depicted as being a plurality of male-type electrical contacts, such as tabs or posts, insofar as they are intended to mate with and be received by female-type electrical contacts such as disclosed at 20. In a preferred embodiment, rear electrical contacts 70 are embedded into and extend from rear face 72 of guide sleeve 68. Rear electrical contacts 70 are shown as being electrically connected to posts 76 which are to be embedded into and electrically connected with first substrate 10, shown in FIG. 1 as a printed circuit board. Guide sleeve 68 has tabs 78 and 80 for removably securing guide sleeve 68 to first substrate 10 via screws 82 and 84.

Guide sleeve 68 has interior 86 which is rounded and designed to be tapered in a manner to mate with tapered extension 44 through opening 87. In a preferred embodiment, interior 86 has dimensions suitable to envelope tapered extension 44 without significant contact with tapered extension 44 and while allowing front electrical contacts 20 to securely engage rear electrical contacts 70 within interior 86. In addition, the design of interior 86 allows for movement, due to vibration or otherwise, of tapered extension 44. Also shown in FIG. 2 is seal 86*a* which is designed to contact interior 86 when tapered extension 44 is inserted into guide sleeve 68 and to prevent moisture and/or dust from contacting front electrical contacts 20 and/or rear electrical contacts 70. Seal 86*a* is further advantageous in that its design aids in the dampening of vibrations which may adversely effect the electrical contact elements.

It is to be understood that each of the back contact panel 32, tapered housing 18, front collar panel 34 and guide sleeve 68 may be fashioned from any suitable electrically insulating material such as plastics or nylon polymers or the like. In an alternate embodiment, the back contact panel 32 and the front contact panel 34 are a unitary structure which encloses tapered housing 18 in a movable fashion. It is to be further understood that the electrical connectors or leads described above may be fashioned from any suitable electrically conductive material well-known to those skilled in the art.

Installation and interconnection of one embodiment of the electrical connector assembly of the present invention is now described as follows with reference to FIGS. 1 and 2. Tapered housing 18 is inserted against back contact panel 32 with exterior leads 24 extending through back contact panel 32. Front collar panel 34 is inserted over tapered extension 44 via opening 42 and is fixedly mounted to back contact panel 32 via snaps 48 and 50. Spring mechanism 46*a* abuts the interior 46*b* of collar 46. Tapered housing 18 is movable in any direction within the plane of front collar panel 34 and also in a backward and forward motion within the confines of back contact panel 32 and front collar panel 34. The movability in any direction of tapered housing 18 advantageously facilitates a tolerance between the front electrical connectors 20 and corresponding electrical connectors when being interconnected.

Front collar panel 34 is then removably mounted to second substrate 12 while guide sleeve 68 is removably mounted to first substrate 10 and posts 76 are electrically connected, via soldering or other means known in the art, to first substrate 10. Guide sleeve 68 including rear electrical contacts 70 of first substrate 10 is then aligned along a longitudinal axis with tapered housing 18 and front electrical contacts 20. The two sets of electrical contacts are then brought toward each other via some mechanical means such as a robotic means. The tapered extension 18 is guided towards and into interior 86 of guide sleeve 68 via opening 87. It is important to note that opening 87 of guide sleeve 68 is of a dimension greater than the front face 22 of tapered extension 44. This arrangement facilitates ease of entry of tapered extension 44 into guide sleeve 68 despite some misalignment. As tapered extension 44 is received into interior 86 of guide sleeve 68, the front electrical contacts 20 will easily mate with the rear electrical contacts 70 should they be aligned on a precise longitudinal axis. If, however, the two sets of electrical contacts 20 and 70 are misaligned, they will become self-aligning as the tapered extension 44 is slidably guided toward the rear face 72 of the guide sleeve 68. Since the tapered housing 18 is movably disposed within the confines of back contact panel 32 and front collar panel 34, as tapered extension 44 contacts the rounded interior 86 of guide sleeve 68, due to the misalignment, tapered extension 44 will adjust and shift toward the aligned longitudinal axis between the two electrical contacts 20 and 70 until the two electrical contacts 20 and 70 mate. The tolerance advantage gained by a movable tapered housing 18 corrects for the misalignment of the two electrical connectors.

Figure 4:
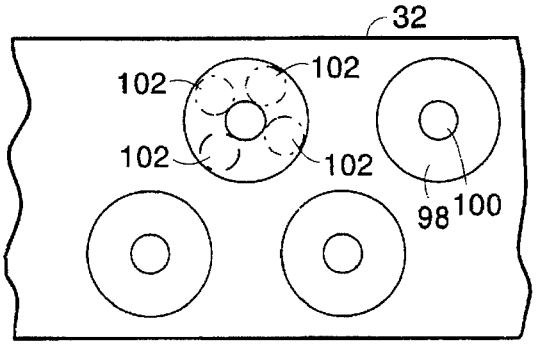
FIG. 4 is a graphical representation of the relative movement of electrical connecting components of the electrical connector assembly of FIG. 3.
Figure 3:
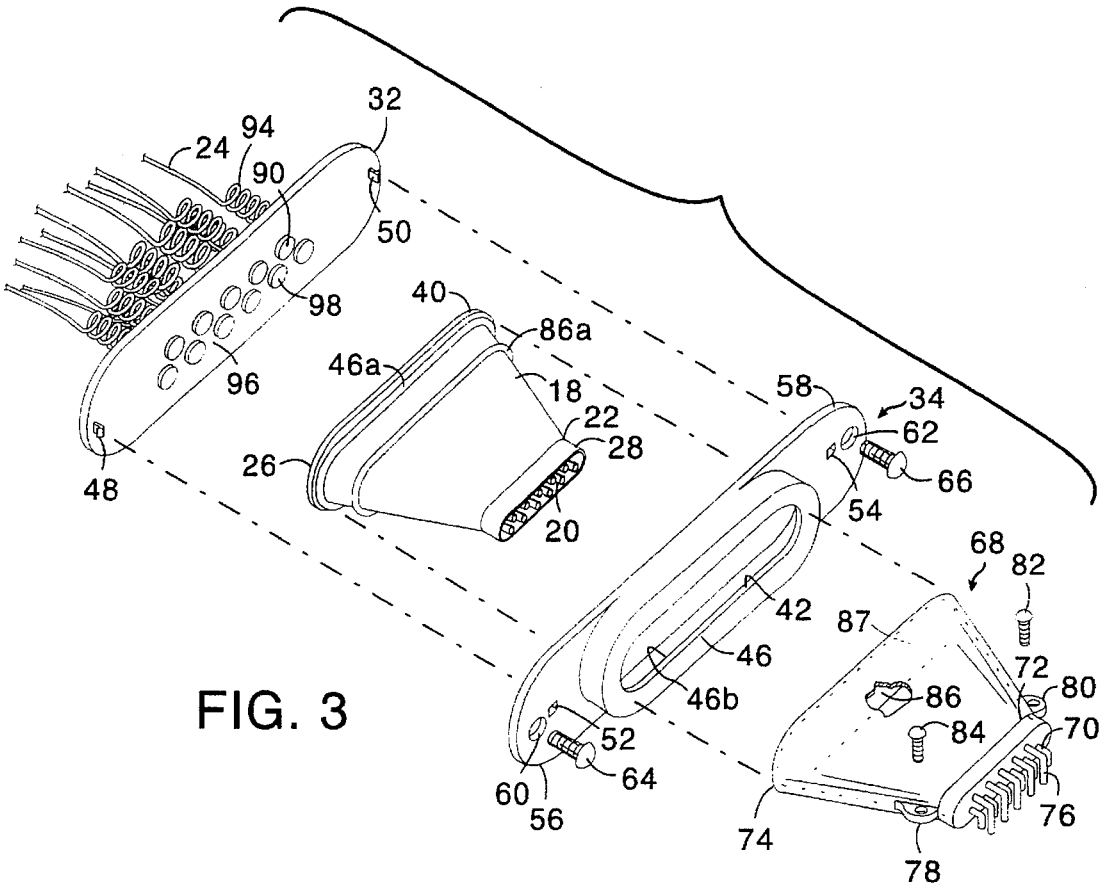
FIG. 3 is an exploded view of an alternate embodiment of an electrical connector assembly of the present invention.
Figure 3A:
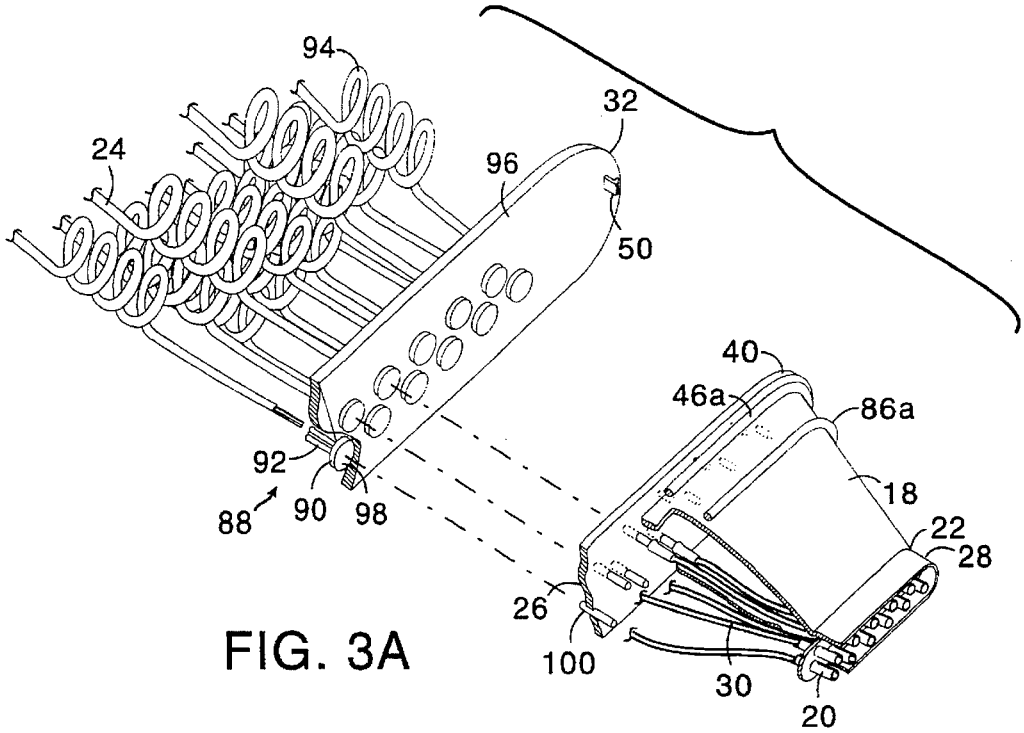
FIG. 3A is an exploded view, partially broken away, of the connector means of FIG. 3.

A alternate embodiment of the present invention is depicted in FIG. 3 and FIG. 3A. For the sake of convenience, features identical between FIG. 2, FIG. 3 and FIG. 3A will have identical identifying numbers. FIG. 3 and FIG. 3A depict the embodiment of FIG. 2 including a novel connection mechanism shown generally at 88 which electrically connects front electrical contacts 20 with corresponding exterior leads 24. Back contact panel 32 has flat electrical contact pads 90 disposed in corresponding apertures via extensions 92 which are connected to corresponding lead wires 94. In a preferred embodiment, lead wires 94 are of a pig tail type to allow for vibration and/or movement of lead wire 94. Flat electrical contact pads 90 may be in any configuration and are preferably circular in shape and having a diameter larger that their corresponding apertures to allow each flat electrical contact pad 90 to rest on a surface 96 of back contact panel 32 and to expose a contact surface 98. Back face 26 of tapered housing 18 has back electrical contacts 100 which are disposed within and extending through back face 26. Back electrical contacts 100 are electrically connected to corresponding front electrical contacts 20 via wires 30. In a preferred embodiment, back electrical contacts 100 have a rounded contact head and are fixedly disposed within back face 26. When back contact panel 32 is secured to front collar panel 34 thereby movably enclosing tapered housing 18, each back electrical contact 100 electrically contacts a corresponding flat electrical contact pad 90 at its corresponding surface 98. This contact is graphically depicted in FIG. 4 which shows a section of back contact panel 32, surface 98 of flat electrical contact 90, and the contact position of back electrical contact 100. Preferably, the contact position of back electrical contact 100 with flat electrical contact 90 will be at or near the center of the surface 98 of flat electrical contact 90. However, as previously described, some misalignment may occur during insertion of the tapered extension 44 into guide sleeve 68 which may lead to the back electrical contact 100 connecting the surface 98 of flat electrical contact 90 at a position somewhat off center. The ability of the tapered housing to move in all directions, i.e. backward and forward and within a 360 degree radius of the surface 98 of flat electrical contact 90, allows the two electrical contacts to be electrically connected without perfect alignment which may occur due to the movement of tapered extension 18 during the connection process. The novel connector mechanism is useful in that it allows the two electrical connectors to maintain a useful electrical connection despite movement during installation or later use between the two electrical connectors. The range of movement is graphically depicted at various positions 102 in FIG. 4 which indicate that the back electrical contact 100 has a freedom of movement in any direction on the surface 98 of flat electrical contact 90, i.e. within a 360 degree radius of the surface 98.

It is to be understood that the embodiments of the invention which have been described are merely illustrative of some applications of the principles of the invention. Numerous modifications may be made by those skilled in the art without departing from the true spirit and scope of the invention.

What is claimed is:

1. An electrical connector assembly comprising a tapered housing having front electrical contacts disposed at a from face of the tapered housing and having exterior leads at a back face of the tapered housing with the front electrical contacts being electrically connected to corresponding ones of the exterior leads, the tapered housing being movably disposed between a back contact panel and a front collar panel, the front collar panel having an opening through which the tapered housing extends thereby forming a tapered extension, and a guide sleeve having a tapered interior for receiving the tapered extension and having electrical contacts disposed at a rear section of the guide sleeve for mating with corresponding ones of the front contacts of the tapered housing.

2. The electrical connector assembly of claim 1 wherein the tapered housing is movably disposed in any direction between the back contact panel and the front collar panel.

3. The electrical connector assembly of claim 2 wherein the tapered housing has a spring mechanism fixedly connected thereto for engaging the front collar panel.

4. The electrical connector assembly of claim 3 having a seal surrounding the tapered extension for contacting the tapered interior of the guide sleeve.

5. The electrical connector assembly of claim 4 wherein each front electrical contact is electrically connected to the corresponding exterior lead by a connection mechanism comprising a back electrical contact electrically connected to the corresponding front electrical contact and disposed at the back face of the tapered housing and a flat electrical contact pad electrically connected to a corresponding exterior lead and disposed at the back contact panel, and each back electrical contact of the tapered housing being movably contacted in all directions with a surface of a corresponding flat electrical contact pad.

6. The electrical connector assembly of claim 4 wherein the tapered housing ends in a protector within which the front electrical contacts reside.

7. The electrical connector assembly of claim 6 wherein the back face of the tapered housing has a flange having a configuration to prevent the tapered housing from passing through the opening of the front collar panel.

8. The electrical connector assembly of claim 5 wherein the back electrical contacts of the tapered housing have a rounded contact head.

9. The electrical connector assembly of claim 7 wherein the guide sleeve has connector means for removably joining the guide sleeve to a first substrate.

10. The electrical connector assembly of claim 9 wherein the back contact panel has snap connectors for being removably connected to the front collar panel.

11. The electrical connector assembly of claim 10 wherein the front collar panel has connector means for removably joining the front collar panel to a second substrate.

12. The electrical connector assembly of claim 11 wherein the electrical contacts of the guide sleeve are mountable on a printed circuit board.

* * * * *